US006966815B2

(12) United States Patent
Weinerth

(10) Patent No.: US 6,966,815 B2
(45) Date of Patent: Nov. 22, 2005

(54) SHAPED ANTI-ROLL SUPPORTS AND GARMENTS INCORPORATING SUCH SUPPORTS

(75) Inventor: Peter Weinerth, Santa Domingo (DO)

(73) Assignee: Invists North America S.R.R.L., Wilmington, DE (US)

( * ) Notice: Subject to any disclaimer, the term of this patent is extended or adjusted under 35 U.S.C. 154(b) by 394 days.

(21) Appl. No.: 10/172,123

(22) Filed: Jun. 14, 2002

(65) Prior Publication Data

US 2003/0232571 A1 Dec. 18, 2003

(51) Int. Cl.[7] ..... A41C 3/00
(52) U.S. Cl. ..... 450/41; 450/39
(58) Field of Search ..... 450/39, 40, 41, 450/45, 47, 48, 51, 52, 107, 109, 114, 143, 450/146; 2/255–264, 67, 69

(56) References Cited

U.S. PATENT DOCUMENTS

| | | | | |
|---|---|---|---|---|
| 2,915,067 A | | 12/1959 | Bracht | |
| 2,964,756 A | | 12/1960 | Liebowitz | |
| 2,992,646 A | * | 7/1961 | Weinberg | 450/41 |
| 3,225,768 A | * | 12/1965 | Galitzki et al. | 451/41 |
| 3,351,954 A | * | 11/1967 | Chalfin et al. | 2/255 |
| 4,172,002 A | | 10/1979 | Gluckin | |
| 4,372,321 A | | 2/1983 | Robinson | |
| 4,740,258 A | * | 4/1988 | Breitscheidel | 156/209 |
| 4,867,826 A | * | 9/1989 | Wayte | 156/219 |
| 5,490,890 A | * | 2/1996 | Morrison | 156/66 |
| 6,425,800 B1 | * | 7/2002 | Huang | 450/41 |
| 6,439,959 B1 | * | 8/2002 | Magrone et al. | 450/41 |

FOREIGN PATENT DOCUMENTS

| | | |
|---|---|---|
| DE | 201 03 387 U1 | 2/2001 |
| EP | 0 734 660 A1 | 10/1996 |
| WO | WO 01/08516 | 2/2001 |

* cited by examiner

*Primary Examiner*—Gloria M. Hale
(74) *Attorney, Agent, or Firm*—Robert B. Furr, Jr.; Anne I. Breikss

(57) ABSTRACT

A shaped support for a body-shaping garment, including a foundation garment, such as a brassiere or girdle, is formed from a single or from multiple layers of a plastic material having certain flex modulus and perpendicular and in-plane apparent stiffnesses, such as a polyester film with a thickness in the range of from 15 to 35 mil. The shaped support is incorporated into the structure of the body-shaping garment, preferably by adhering the support directly to the fabric comprising the body-shaping garment using a film or hot melt adhesive. The shaped support preferably has an asymmetric shape and readily conforms to various body curvatures for increased wearing comfort, but has sufficient stiffness to provide desired lifting or holding support.

19 Claims, 2 Drawing Sheets

SHAPED ANTI-ROLL SUPPORTS AND GARMENTS INCORPORATING SUCH SUPPORTS

Some molded brassiere cups include auxiliary support patches adhered to fabric to form a laminate structure that is introduced into the mold for forming the brassiere cup. U.S. Pat. Nos. 4,172,002 and 4,372,321 suggest forming a support patch or reinforcement support with a moldable fabric compatible with the fabric used to mold the brassiere cup. The support is fused with a hot melt adhesive to the fabric that ultimately forms the brassiere cup during the molding step.

BACKGROUND OF THE INVENTION

Various means for stiffening and shaping brassiere cups and other women's foundation garments, undergarments and bathing suits have been disclosed in the art. As one example, metal or rigid thermoplastic underwires formed into a U-shape are encased in fabric or foam and extend around the lower peripheral portion of a brassiere cup or bathing suit top to provide lifting support. Such wires can cause wearer discomfort in many instances. First, a sharp end of the wire can protrude through the fabric covering and poke the wearer. Second, the rigidity of the formed wire frequently does not conform to the curvature of the wearer's torso. Hence, as the wearer moves, the underwire portion of the garment does not stay in comfortable contact with the wearer's torso. Third, prior art supports generally have a constant diameter (or width) and thickness along their length, which can contribute to their inability to conform more closely to the curvature of the wearer's body and to shape the same.

Some molded brassiere cups include auxiliary support patches adhered to fabric to form a laminate structure that is introduced into the mold for forming the brassiere cup. U.S. Pat. Nos. 4,172,002 and 4,371,321 suggest forming a support patch or reinforcement support with a moldable fabric compatible with the fabric used to mold the brassiere cup. The support is fused with a hot melt adhesive to the fabric that ultimately forms the brassiere cup during the molding step.

Some brassieres and girdles incorporate other thermoplastic materials as stiffening supports, e.g., U.S. Pat. No. 2,915,067 and WO 01/08516 A1. When such stiffening supports are sewn into the construction, they suffer from many of the same drawbacks associated with underwires. These bonded thermoplastic supports in the prior art have not addressed the problems associated with rolling when the garment does not conform comfortably to the curvature of the wearer's torso. Either the thermoplastic support lacks sufficient stiffness to hold a desired body-shaping configuration or the fabric components of the garment fold or roll over the support.

SUMMARY OF THE INVENTION

It has now been discovered that a shaped support comprising a plastic material having certain stiffness properties incorporated into a body-shaping garment can function both to prevent fabric roll in the garment under load and to shape the body held in the garment.

A shaped support for a body-shaping garment, including a foundation garment such as a brassiere, bustier or girdle, or lingerie, or a swimsuit, is formed from a single or from multiple layers of a plastic material having a Perpendicular Apparent Stiffness in the range of about 3.1 kg-cm$^2$ to 39 kg-cm$^2$, and an In-plane Apparent Stiffness in the range of about 1936 kg-cm$^2$ to 4517 kg-cm$^2$, such as a polyester film with a thickness in the range of from about 15 to 35 mil (about 0.38 to 0.90 mm). The shaped support is incorporated into the structure of the body-shaping garment, preferably by adhering the support directly to the fabric comprising the body-shaping garment, for example, by using a hot melt adhesive. The width of the shaped support can vary along its length according to the desired support function. The thickness of the shaped support also can vary along its length. The shaped support readily conforms to various body curvatures for increased support and wearing comfort. It helps to prevent the body shaping garment fabric from rolling or twisting out of desired position on the wearer's body.

DESCRIPTION OF THE DRAWINGS

The invention will be more fully understood by referring to the detailed specification showing preferred embodiments and the claims taken in connection with the following drawings.

DESCRIPTION OF THE PREFERRED EMBODIMENTS

The invention has application to various body-shaping garments, including foundation garments such as brassiers, bustiers or girdles, and lingerie and swimwear. The preferred embodiments of the invention will be described below with reference to brassieres, but should be understood to include other body-shaping garments as known in the industry.

The plastic material used to form the shaped support of the invention has a Perpendicular (to the major plane of the material) Apparent Stiffness in the range of about 3.1 kg-cm$^2$ to 39 kg-cm$^2$, and an In-Plane (across the width of the plastic material) Apparent Stiffness in the range of about 1936 kg-cm$^2$ to 4517 kg-cm$^2$). With stiffness properties in these ranges, the shaped support has sufficiently high rigidity against loads applied substantially to an edge (and across the width) of the shaped support (for example, in a brassiere under a breast for fabric roll prevention), and sufficient but lower rigidity against loads applied substantially perpendicular to the plane of the support (for example, in a brassiere at the side of a breast for shaping). The Perpendicular Apparent Stiffness is also low enough to permit the shaped support in a brassiere to bend or curve around the torso or rib cage of the wearer so that to the shaped support's edge is presented to the load in front and the shaped support's plane is presented to the load at the side. If the Apparent Stiffness values are too low, the shaped support provides inadequate shaping and roll-prevention. If the Apparent Stiffness values are too high, the shaped support cannot accommodate the curvature of the wearer's body and can be uncomfortable.

For improved comfort, the shape of said shaped support preferably has a length and has a proximal end and a distal end and a midpoint between the proximal end and distal end, and said shaped support has a first surface defining a first plane, wherein said shaped support is substantially asymmetrical about an axis lying in the first plane and extending through the midpoint of the shape. For improved comfort, shaping and support, it is more preferred that the shaped support of the invention be substantially lacking a two-fold axis of symmetry. As used herein, "substantial two-fold axis of symmetry" means an imaginary axis line lying in the plane of a shaped support and through a midpoint between the proximal end and distal end of the shaped support, and about which the shaped support can be rotated 180° without substantially altering the shape (outline) of the support.

When used as described below in a brassiere, the shaped support comprising the shaped material having the Perpendicular and In-Plane Apparent Stiffnesses delimited elsewhere herein provides both high stiffness to prevent roll under a bra cup and moderate stiffness to urge the side of a breast in a desired direction. It was unexpected that a shaped support comprising a single reinforcing plastic material would accomplish both functions.

Figure 1:
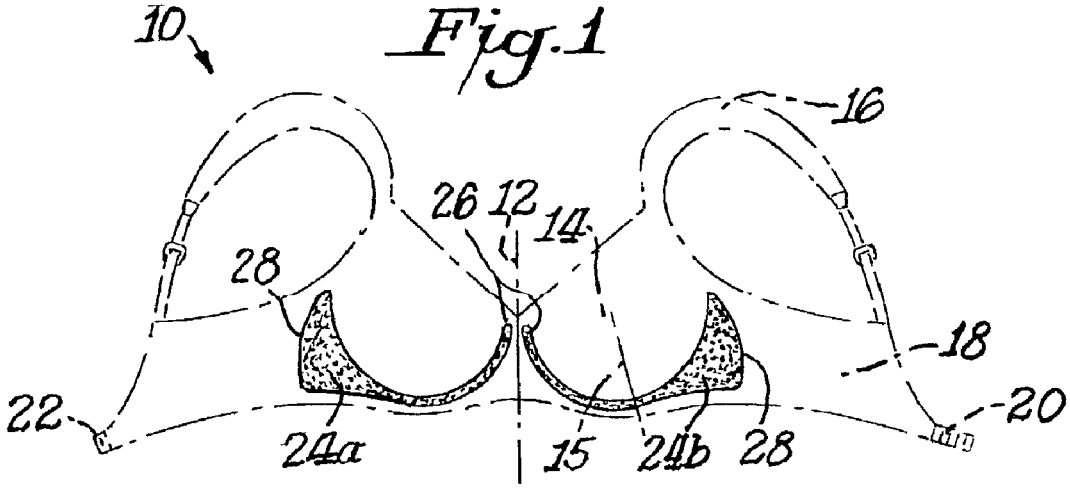
FIG. 1 is a brassiere shown in phantom outline, which incorporates two shaped supports of a first embodiment according to the invention.

Referring first to FIG. 1, a brassiere 10 is shown in phantom outline. The brassiere 10 has a centerline 12, with two breast supporting regions or cups 14 spaced apart on either side of the centerline 12. The brassiere further includes shoulder straps 16 that connect the upper portion of each breast supporting region 14 with the body wrapping sides 18 of the brassiere 10. The sides 18 terminate with engageable clasp means 20, 22 to hold the brassiere 10 in place about a wearer's torso when the brassiere is worn.

Shaped supports 24*a* and 24*b* are attached onto or immediately adjacent to portions of the breast supporting regions 14. The shaped supports 24*a* and 24*b* each have a length and a proximal end 26 and a distal end 28, where the proximal ends 26 are closer to the centerline 12. The shaped supports 24*a* and 24*b* are curved to fit under the wearer's breasts for increased wearer comfort. The width of each shaped support 24*a* and 24*b* at its proximal end 26 can be less than the width at its distal end 28, wherein a flared portion can be formed that urges the wearer's breasts inwardly. This is one of the possible desired shapes for a shaped support 24*a* according to the invention.

Imaginary axis 15 extends in the plane of the shaped support 24*b* and through the mid-point between the proximal 26 and distal 28 ends of the support. The shaped support 24*b* forms an arc along one side edge and axis 15 is drawn along the radius of such arc between the center point of the arc and the mid-point of the shaped support 24*b*. The shaped support 24*b* is not symmetric about the axis 15 through the mid-point of the support, and can be positioned to increase the support under and beside the wearer's breasts for roll prevention/support and shaping, respectively. Similarly, shaped support 24*a* is not symmetric about an axis (not shown) through the mid-point of such support. These shaped supports 24*a* and 24*b* have sufficient stiffness to urge the breasts upwardly (toward the straps 16) and preferably inwardly (toward the centerline 12).

Figure 2:
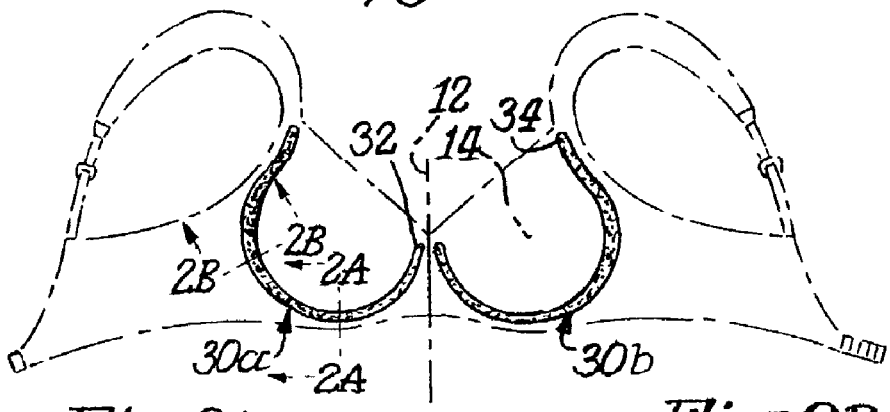
FIG. 2 is a brassiere shown in phantom outline, which incorporates two shaped supports of a second embodiment according to the invention.

Referring next to FIG. 2, a second embodiment of shaped supports 30*a* and 30*b* is shown. Each shaped support 30*a* and 30*b* is attached onto or immediately adjacent to a lower portion of a corresponding breast supporting region 14 of the brassiere. The shaped supports 30*a* and 30*b* each have a length and a proximal end 32 and a distal end 34, where the proximal ends 32 are closer to the centerline 12. The shaped supports 30 are curved to fit under and around the wearer's breasts for increased wearer comfort and roll prevention/support. The width of each shaped support 30*a* and 30*b* varies along its length, wherein the width is greater in a region of each support that is about midway between the proximal and distal ends. This desired shape of the shaped supports 30*a* and 30*b* urges the wearer's breasts toward the centerline 12 and provides anti-roll support under the breast supporting region 14.

Figure 2A:
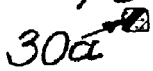
FIG. 2A is a cross-sectional view taken along line 2A—2A of FIG. 2.
Figure 2B:
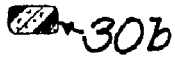
FIG. 2B is a cross-sectional view taken along line 2B—2B of FIG. 2.

In FIGS. 2A and 2B, cross-sectional views of the shaped support 30*a* of FIG. 2 show that the shaped support 30*a* is formed with a thickness that varies along its length. The shaped support 30*a* is thicker at its middle (FIG. 2B) than at a point closer to the distal end under the breast supporting region (compare FIG. 2A). In a preferred embodiment, the shaped support 30*a* is made by stacking two or more plastic film layers to create thicker regions and thinner regions. The stacking may be by folding a single film or by layering separate films. The stacked films may be joined together in a separate step or fused together when the body shaping garment components are heat sealed together. Alternatively, a plastic shaped support with varying thickness may be formed by injection molding.

Figure 4:
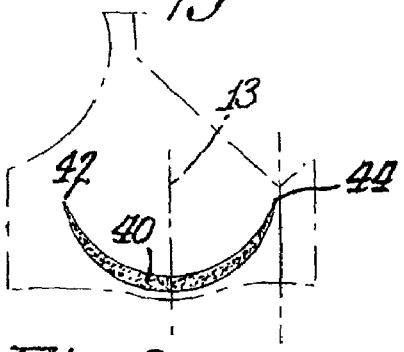
FIG. 4 is a portion of a brassiere shown in phantom outline, which incorporates a shaped support of a fourth embodiment according to the invention.

Alternate shaped supports are shown in FIGS. 4 to 7, each of which Figures represents one-half of a brassiere construction. In FIG. 4, the shaped support 40 has a crescent-shape (not substantially U-shaped) in which the width of the support 40 is greatest at its central portion and smallest at its proximal and distal ends 42, 44. The shaped support 40 provides additional roll prevention/support under the wearer's breasts. Such support 40 has an axis of symmetry 13, in this instance because each side of the crescent from this axis is a mirror image of the other side. This symmetrical shape is less preferred than alternative embodiments which have an asymmetric shape along an axis extending in the plane of and through the midpoint of the shaped support.

Figure 5:
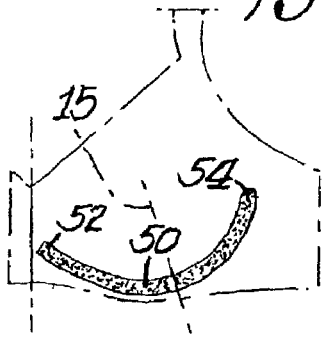
FIG. 5 is a portion of a brassiere shown in phantom outline, which incorporates a shaped support of a fifth embodiment according to the invention.

The shaped support 50 in FIG. 5 has a shape more resembling an "L" than a crescent or a "U". The width of the shaped support 50 can be substantially constant. In this embodiment, the shaped support is asymmetric about an axis 15, which is an imaginary axis in the plane of the shaped support 50 and through a midpoint between the proximal 52 and distal 54 ends.

Figure 6:
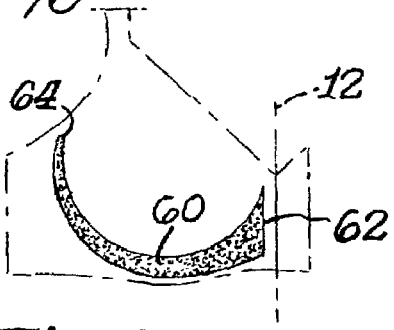
FIG. 6 is a portion of a brassiere shown in phantom outline, which incorporates a shaped support of a sixth embodiment according to the invention.

In FIG. 6, the shaped support 60 has a proximal end 62 with a width significantly greater than the width of its distal end 64. The shaped support 60 is curved to provide support under a wearer's breast. It shapes the wearer's body by urging the breasts upward as well as outward and away from the centerline 12 of the brassiere. This shaped support 60 is asymmetric about an axis (not shown) in the plane of the support and through the midpoint between the proximal end 62 and distal end 64.

Figure 7:
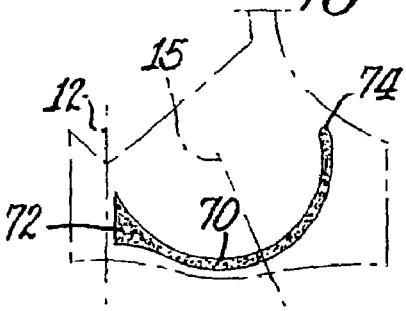
FIG. 7 is a portion of a brassiere shown in phantom outline, which incorporates a shaped support of a seventh embodiment according to the invention.

The shaped support 70 in FIG. 7 also has a greater width at its proximal end 72 as compared to its distal end 74 with a flared portion at its proximal end 72, and provides shaping support by urging the wearer's breast upward as well outward and away from the centerline 12 of the brassiere. This shaped support 70 has an asymmetric shape about an axis 15 in the plane of and through the midpoint of the shaped support.

Figure 8:
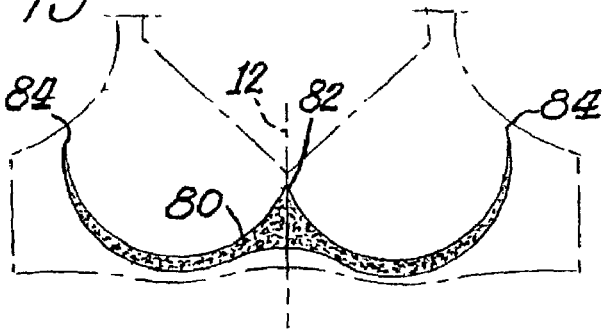
FIG. 8 is a brassiere shown in phantom outline, which incorporates a shaped support with two lobes, of an eighth embodiment according to the invention.

As shown in FIG. 8, a shaped support 80 can be formed as one integral component to provide body-shaping to both of the wearer's breasts when such shaped support is incorporated into a brassiere construction. The shaped support 80 is symmetrical to the centerline 12, which also forms the axis of the shaped support. It has a proximal end 82 formed at the centerline 12 and two distal ends 84. The width of the shaped support 80 varies from its widest point at the line 12 to its narrowest point at the distal ends 84. However, a brassiere comprising a single shaped support for supporting both breasts may be less comfortable than a brassiere comprising independent supports, and is therefore not preferred.

Figure 9:
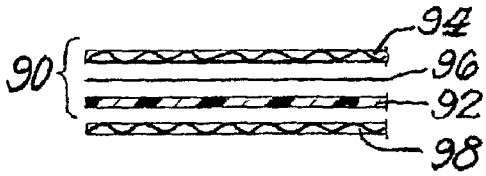
FIG. 9 is a fragmental cross-sectional view in side elevation showing layers that form an embodiment of a shaped support according to the invention.

Referring to FIG. 9, the shaped supports of the invention are formed as a laminate structure 90 integral in the body-shaping garment. Such a laminate 90 includes a layer of a plastic film 92 adhered to a fabric layer 94 with an adhesive 96. An inner fabric layer 98 is adjacent to the plastic film. In this embodiment, the inner fabric layer 98 may be sewn or otherwise incorporated into the structure of the body-shaping garment, for example, by adhesive 96 being of greater extent than film 92 so that it bonds to fabric layer 98 and thereby "encapsulates" film 96 next to fabric layer 98. It need not be adhered to the laminate 90.

Figure 10:
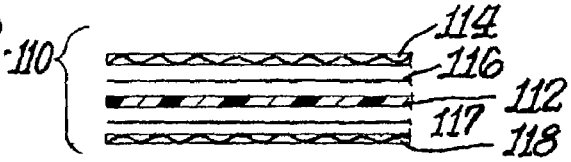
FIG. 10 is a fragmental cross-sectional view in side elevation showing layers that form an alternative embodiment of a shaped support according to the invention.

As shown in FIG. 10, the shaped supports are formed as an alternate embodiment laminate structure 110 having a layer of plastic film 112 adhered to a fabric layer 114 with an-adhesive 116 and adhered to a second fabric layer 118 with an adhesive 117.

In the laminates 90, 110 shown in FIGS. 9 and 10, the plastic film preferably is a polyester film such as MYLAR® polyester film, in thicknesses from 15 to 35 mil. The film may be stacked in layers to provide thicker regions and thinner regions along the length of the shaped support incorporated into the laminate.

Figure 11:
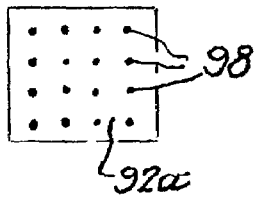
FIG. 11 is a fragmental top plan view of an adhesive pattern that may be used for laminating together the layers to form a shaped support according to the invention.

In the laminates 90, 110 shown in FIGS. 9 and 10, the adhesive preferably is a polyurethane film adhesive, such as SEWFREE® Type 3410 from Bemis Associates, Inc. of Shirley, Mass. The film adhesive is offered in varying film thicknesses starting from 1 mil (0.001 inch or 0.025 mm). It can adhere to fabrics customarily used to form body shaping garments at temperatures between about 150 to 165° C., and can heat seal fabric components together at higher temperatures (up to 200° C.) and under compression in a platen press at pressures up to 3.5 Bar. Alternatively, the laminates may be formed using dot pattern of hot melt adhesive, such as known to those skilled in the art. As shown in FIG. 11, dots of adhesive 98 may be applied to the surface of the film 92*a* in a regular grid pattern, such as by application of a liquid adhesive through a screen. Where appropriate, an irregular dot pattern may be used. Further alternative adhesive means known for use in the garment industry may also be used.

In the laminates 90, 110 shown in FIGS. 9 and 10, the fabric layers 94, 98, 114, 118 may be the same or different materials. Preferred fabrics include stretch materials such as cotton/spandex, nylon/spandex, polyester/spandex, and other textile yarns combined with spandex. More rigid fabrics can even be used for some applications. In one preferred embodiment, the outer fabric layer 94 or 114 is a cotton/LYCRA® (a registered trademark of E. I. duPont de Nemours & Company, Inc.) spandex single jersey knit, which forms the breast supporting cup and back portions of the brassiere construction. In this same preferred embodiment, the inner fabric layer 98 or 118 is a cotton/polyester 48/52 blend knit. The inner fabric layer has an inner surface adjacent or nearly adjacent to the plastic film and an outer surface. The outer surface, which will be in contact with the wearer's body after the laminate has been formed into a body shaping garment, preferably is napped for added softness.

A preferred method of making a body shaping garment according to the invention includes first forming or cutting a plastic material into a desired shape and thickness(es) to provide body shaping support. The plastic material can be a polyester film such as MYLAR® Type D (a registered trademark of DuPont-Teijin Films, Inc.) polyester film, in thicknesses from about 15 to 35 mil. The plastic material can also be polyolefin, polyamide, polyimide, fluoropolymer, and the like. If the Apparent Stiffness of the plastic material is too low, it can optionally be reinforced, for example with appropriate amounts of a reinforcing fiber to form a composite. When the plastic is available as a film, the film can be stacked or folded in two or more layers before cutting.

The Perpendicular Apparent Stiffness and In-Plane Apparent Stiffness of the plastic material can be determined according to the International Standard Method ISO 178 "Plastics—Determination of flexural properties". For example, the flex modulus of a Mylar® D polyester film 10 mil (0.25 mm) thick was measured on rectangular specimens 25 mm long and 9.5 mm wide, cut from a larger sheet conditioned for 24 hours at 23° C. and 50% relative humidity. Each specimen was supported symmetrically 5 mm apart at two supports each having a radius of curvature of 3 mm. Force was applied with a load point having a radius of curvature of 3 mm, attached to a cross-head operated at a deflection speed of 0.18 mm/min. The test was repeated on five specimens, and an average value of the flex modulus of 0.83 MPSI (5.7 GPa) was reported.

In order to arrive at a property dependent on the width and thickness of the shaped support, the flex modulus (a property dependent only on the material itself and not on its size and shape) was converted to Perpendicular Apparent Stiffness by multiplying the flex modulus by the sample width and the result by the cube of the sample thickness and to In-Plane Apparent Stiffness (assuming no buckling) by multiplying the flex modulus by the sample thickness and the result by the cube of the sample width. Plastic material having a Perpendicular (to the major plane of the plastic material) Apparent Stiffness in the range of about 1.0 pounds-inches$^2$ to 13 pounds-inches$^2$ (about 3.1 kg-cm$^2$ to 39 kg-cm$^2$) and an In-Plane (across the width of the plastic material) Apparent Stiffness in the range of about 662 pounds-inches$^2$ to 1544 pounds-inches$^2$ (about 1936 kg-cm$^2$ to 4517 kg-cm$^2$) is useful in the shaped support of the invention, corresponding to that of about 9.5 mm wide Mylar® Type D polyester film having a thickness of about 15 mils to 35 mils (about 0.38 mm to 0.89 mm).

Various methods can be used to cut the plastic material to form a desired shape. The specific method should be selected with reference to the material being cut and the desired manufacturing efficiency. Die-cutting, laser-cutting or computer-numerically controlled cutting methods can be used. Laser-cutting is particularly preferred for cutting polyester films, singly or in a stack. As cut, the shaped support of the invention typically has at least one planar or substantially planar face for attachment to a surface of a garment construction. The shaped support can curve and bend to assume a three-dimensional conformation when the garment into which the shaped support is incorporated is worn. Moreover, the shaped support may have portions with varying thickness to enhance support and body-shaping. Alternatively, the plastic material may be molded to form the desired shape.

After the plastic material has been cut or otherwise formed into a desired shape, the plastic material is attached to at least a portion of the rear surface of a first fabric layer in a desired position to enhance the body shaping function of the body shaping garment. Preferably, the first fabric layer has been cut to the desired shape, and in the case of a brassiere, will have cup portions and side portions, and the plastic material will be positioned in, on the side of and/or just below the cup portions. The front surface of the fabric forms the front surface of the body shaping garment. The plastic forms the shaped support in the body shaping garment. Preferably, the plastic material is attached with a film adhesive or hot melt adhesive such as those previously described with reference to FIGS. 9, 10 and 11.

The rear surface of the fabric layer and the plastic material adhered thereto are then covered with a second fabric layer. The second fabric layer optionally may be adhered to the first fabric layer and plastic material also with an adhesive. The second fabric layer forms the inner lining that touches the body supporting garment wearer's body. The first and second fabric layers may also be sewn together or joined by a combination of adhesive and sewing.

In the preferred method for making a body supporting garment, the laminate of fabric layers and shaped support is heat sealed together to form a seamless support assembly. Thereafter, the fabric layers may be trimmed to create the final body supporting garment shape. In the case of a brassiere with molded cups, the laminate can then be inserted into a mold and heat and pressure can be applied to mold the brassiere cups to a desired contour. Heat sealing machines or bullet-molding machines well known to those in brassiere manufacture can be used for this subsequent processing step. Examples of heat sealing machines are Reliant Model 1.6 Excel from Reliant Machinery, Ltd. and T4P Series RPS-A 1000.

In the case of brassiere manufacture, following cup molding, the straps, slides, hooks and eyes or other closure means are attached to complete the garment.

Figure 3:
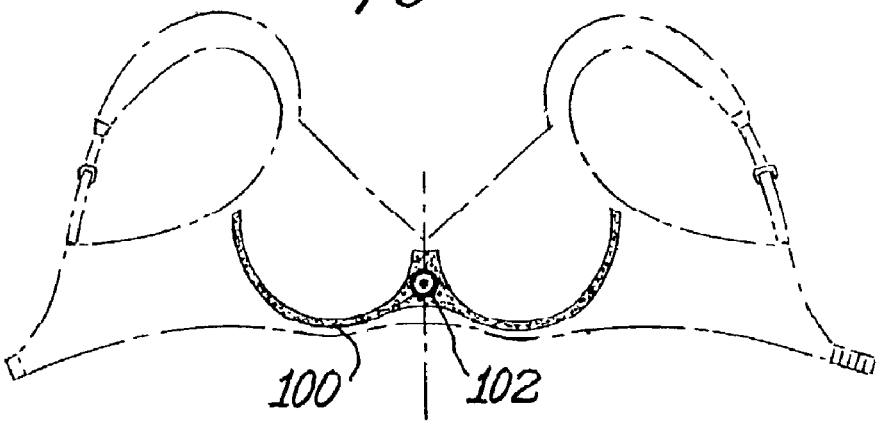
FIG. 3 is a brassiere shown in phantom outline, which incorporates a shaped support with two lobes and a central embossed portion of a third embodiment according to the invention.

As shown in FIG. 3, a shaped support 100 formed as an integral component providing body shaping to both of a wearer's breasts also may be embossed with a design or logo 102. During the heat sealing step of brassiere manufacture (which is under applied heat and compression), a three-dimensional design or logo can be embossed into the thermoplastic (preferably polyester) film. Because the outer layer of fabric is adhered to and in intimate contact with the polyester film, the embossment in the polyester film can readily be observed in the outer fabric layer as well.

The invention has been illustrated by detailed description and examples of the preferred embodiments. Various changes in form and detail will be within the skill of persons skilled in the art. Therefore, the invention must be measured by the claims and not by the description of the examples or the preferred embodiments.

What is claimed is:

1. A shaped support for a body-shaping garment, comprising:

a plastic material having a perpendicular apparent stiffness in the range of from 3.1 kg-cm$^2$ to 39 kg-cm$^2$ and an in-plane apparent stiffness in the range of from 1936 kg-cm$^2$ to 4517 kg-cm$^2$ that is formed into a shape with at least one thickness, said shape having a length and having a proximal end and a distal end and a midpoint between the proximal end and distal end, and said shape having a first surface defining a first plane.

2. The shaped support of claim 1, wherein the plastic material is selected from the group consisting of: polyesters, polyolefins, polyamides, polyimides, and fluoropolymers or composites thereof.

3. The shaped support of claim 1, wherein the plastic material has a plurality of thicknesses along its length.

4. The shaped support of claim 1, wherein the shape has a first width at its proximal end and a second width at its distal end, and wherein the first width is greater than the second width.

5. The shaped support of claim 1, further comprising an adhesive for attaching the plastic material to a fabric, wherein the fabric is a component of the body-shaping garment.

6. A body-shaping garment, comprising:

an inner fabric layer;

an outer fabric layer having a front face and a rear surface; and a shaped support comprising a plastic material having a perpendicular apparent stiffness in the range of from 3.1 kg-cm$^2$ to 39 kg-cm$^2$ and an in-plane apparent stiffness in the range of from 1936 kg-cm$^2$ to 4517 kg-cm$^2$ attached to the rear face of the outer fabric layer and covered by the inner fabric layer.

7. The body-shaping garment of claim 6, wherein the shaped support is attached with an adhesive.

8. The body-shaping garment of claim 7, wherein the shaped support is attached to the outer fabric layer without seams.

9. The body-shaping garment of claim 6, wherein the shaped support is formed into a shape with at least one thickness, said shape having a length and having a proximal end and a distal end and a midpoint between the proximal end and distal end, and said shape having a first surface defining a first plane, wherein said shape is substantially asymmetrical about an axis lying in the first plane and extending through the midpoint of the shape.

10. The body-shaping garment of claim 6, wherein the plastic material is selected from the group consisting of: polyesters, polyolefins, polyamides, polyimides, and fluoropolymers or composites thereof; the outer fabric layer is a cotton/spandex single jersey knit and the inner fabric layer is a cotton/polyester blend knit.

11. The body-shaping garment of claim 6, wherein the garment is a brassiere or bathing suit.

12. A method of making a body-shaping garment, comprising:

providing a plastic material having a perpendicular apparent stiffness in the range of from 3.1 kg-cm$^2$ to 39 kg-cm$^2$ and an in-plane apparent stiffness in the range of from 1936 kg-cm$^2$ to 4517 kg-cm$^2$;

forming the plastic material into a shape with a desired thickness, length and width;

providing a first fabric layer having a front face and a rear face;

attaching the plastic material to the rear face of the first fabric layer, said first fabric layer to form an outer layer of the body-shaping garment; and covering the plastic material with a second fabric layer having a front face and a rear face.

13. The method of claim 12, further comprising attaching the plastic material to the rear face of the second fabric layer.

14. The method of claim 12, wherein the plastic material is a film and the plastic material is formed into a shape by cutting.

15. The method of claim 12, wherein the plastic material is attached to the rear face of the first fabric layer with an adhesive.

16. The method of claim 12, wherein the plastic material is formed into a shape with at least one thickness, said shape having a length and having a proximal end and a distal end and a midpoint between the proximal end and distal end, and said shape having a first surface defining a first plane, wherein said shape is substantially asymmetrical about an axis lying in the first plane and extending through the midpoint of the shape.

17. The method of claim 12, further comprising embossing a pattern into the plastic material.

18. The shaped support of claim 1, wherein the plastic material shape is substantially asymmetrical about an axis lying in the first plane and extending through the midpoint of the shape.

19. The body-shaping garment of claim 11, wherein the shaped support is formed into a shape with at least one thickness, said shape having a first surface defining a first plane where the garment is not worn, wherein said shape flexibly conforms about a curved portion of a wearer's body when the garment is worn.

* * * * *

UNITED STATES PATENT AND TRADEMARK OFFICE

CERTIFICATE OF CORRECTION

PATENT NO. : 6,966,815 B2
DATED : November 22, 2005
INVENTOR(S) : Peter Weinerth It is certified that error appears in the above-identified patent and that said Letters Patent is hereby corrected as shown below:

Title page,
Item [73], Assignee, replace "Invists North America S.R.R.L." with
-- Invista North America S.à.r.l. --.

Signed and Sealed this

Twenty-fourth Day of January, 2006

JON W. DUDAS
*Director of the United States Patent and Trademark Office*